US006565024B2

(12) United States Patent
Getzmann et al.

(10) Patent No.: US 6,565,024 B2
(45) Date of Patent: May 20, 2003

(54) DISPERSING DEVICE

(75) Inventors: Hermann Getzmann, Reichshof (DE); Frank Schieweg, Reichshof (DE)

(73) Assignee: VMA-Getzmann GmbH, Reichshof (DE)

( * ) Notice: Subject to any disclaimer, the term of this patent is extended or adjusted under 35 U.S.C. 154(b) by 71 days.

(21) Appl. No.: 09/847,213

(22) Filed: May 2, 2001

(65) Prior Publication Data

US 2002/0003180 A1 Jan. 10, 2002

Related U.S. Application Data

(63) Continuation of application No. PCT/DE99/03345, filed on Oct. 19, 1999.

(30) Foreign Application Priority Data

Nov. 2, 1998 (DE) ..... 298 19 508 U

(51) Int. Cl.[7] ..... B07C 17/16
(52) U.S. Cl. ..... 241/171; 241/172
(58) Field of Search ..... 241/171, 172

(56) References Cited

U.S. PATENT DOCUMENTS

| | | | | |
|---|---|---|---|---|
| 4,620,673 A | | 11/1986 | Canepa et al. | |
| 4,730,789 A | | 3/1988 | Geiger | |
| 4,824,033 A | * | 4/1989 | Buehler | 241/172 |
| 5,194,783 A | | 3/1993 | Ogino et al. | |
| 5,199,656 A | | 4/1993 | Szegvari et al. | |
| 5,346,147 A | | 9/1994 | Ishikawa | |
| 5,447,372 A | | 9/1995 | Araki et al. | |
| 5,511,881 A | | 4/1996 | Post et al. | |
| 5,967,430 A | | 10/1999 | Getzmann | |

FOREIGN PATENT DOCUMENTS

| | | |
|---|---|---|
| DE | 32 49 928 C3 | 12/1982 |
| DE | 32 49 928 C3 | 6/1995 |
| DE | 195 33 369 C2 | 9/1995 |
| DE | 196 14 295 A1 | 10/1996 |
| DE | 196 14 295 A1 | 11/1996 |
| DE | 195 33 369 C2 | 6/1998 |
| EP | 0 257 740 A1 | 3/1988 |
| EP | 0 261 797 A1 | 3/1988 |
| EP | 0 546 715 A1 | 6/1993 |
| EP | 0 743 091 A1 | 5/1995 |
| FR | 2 738 504 A1 | 3/1997 |
| FR | 2 738 504 A | 3/1997 |
| GB | 637989 | 5/1950 |
| WO | WO 96/33019 | 10/1996 |

* cited by examiner

*Primary Examiner*—Mark Rosenbaum
(74) *Attorney, Agent, or Firm*—Akin Gump Strauss Hauer & Feld, L.L.P.

(57) ABSTRACT

A dispersing device has a container that receives and processes a product to be dispersed and a grinding device with a housing that contains grinding bodies, wherein said housing has openings enabling the product to be dispersed to pass through, an agitating tool arranged in the housing and a first flow-producing device, and wherein the housing and the agitating tool can move relative to one another and at least one shaft protrudes into the housing via a through-opening that allows the product to be dispersed to enter the housing. In order to reliably prevent grinding balls from escaping from the housing or the grinding basket, it is proposed that another flow-producing device be provided in the region of the through-opening between the shaft (21) and the housing (31), which transports the product to be dispersed through the through-opening, out of the container (1) and into the housing (31) during operation and has means to prevent the grinding media from leaving the housing (31).

12 Claims, 5 Drawing Sheets

DISPERSING DEVICE

CROSS-REFERENCE TO RELATED APPLICATION

This application is a continuation of International Application No. PCT/DE99/03345, Filed Oct. 19, 1999, the disclosure of which is incorporated herein by reference.

BACKGROUND OF THE INVENTION

The invention relates to a dispersing device, particularly a ball or bead mill for use as a submersible mill, comprising a container that receives and processes a product to be dispersed, a grinding device with a housing that contains grinding bodies, where said housing has openings enabling the product to be dispersed to pass through, an agitating tool arranged in the housing and a first flow-producing device, where the housing and the agitating tool can move relative to one another and at least one shaft protrudes into the housing via a through-opening that allows the product to be dispersed to enter the housing.

A device of this kind disperses fine to very fine, solid particulate constituents in the liquid phase.

Three sub-steps occur simultaneously during the dispersion process:

1. Wetting of the surface of the solid material to be incorporated by the liquid constituents of the product to be dispersed,
2. Mechanical separation of agglomerates into smaller agglomerates and primary particles, and
3. Stabilization of primary particles, agglomerates and aggregates to prevent renewed clumping (=flocculation).

Although the following description primarily relates to the dispersion of paints and coatings, this processing technique can also be applied in a similar manner in other fields (e.g. biology, food processing technology, pharmacy, agrochemistry, ceramics industry and the like).

A grinding device of this kind is known from U.S. Pat. No. 5,194,783. This patent discloses an agitating submersible mill that disperses according to the circulation process. It essentially consists of a wear-resistant basket filled with grinding media designed as grinding balls, which is submerged in a double-walled container. A cylindrical drive shaft runs through the center of the basket. This drive shaft drives the bar-type agitator mounted inside the basket. The walls of the basket exhibit sieve-like perforations.

When dispersing paints, for example, it is of economic interest to minimize the use of relatively expensive primary colorant particles. The better the dispersion is, the more intense the color effect and gloss are. Thus, good dispersion can, for example, reduce the use of expensive primary colorant particles by permitting the use of cheaper secondary particles. In the ideal situation, each primary particle is wetted separately.

In order to enable circulation of the product to be dispersed through the basket, the drive shaft drives a flow-producing device in addition to the agitator. This flow-producing device must be positioned outside the basket in order to ensure adequate flow. Thus, the drive shaft penetrates the basket. A separating and sealing system is fitted at the point of penetration to prevent the grinding balls from escaping from the basket. The central position of the flow-producing device has definite advantages in terms of fluid mechanics, because it ensures uniform circulation throughout the container.

However, in order to carry out an economical dispersion process using the dispersing device known from the prior art, the product to be dispersed must be pre-dispersed. Pre-dispersion is preferably performed using a dissolver disk due to the fact that optimum pre-dispersion is indispensable from an economic standpoint, particularly in the case of agglomerates that are difficult to disperse and require the use of the grinding device during subsequent processing. An inadequately pre-dispersed product not only necessitates longer running times of the grinding devices known from the prior art, but it also frequently happens that the desired fineness is not attained. As a rule, omissions or errors in pre-dispersion cannot be compensated for by other systems, particularly because inadequately pre-dispersed products clog the holes in the basket during subsequent use of the grinding device, this hindering, or even completely stopping, circulation through the basket.

Although very satisfactory grinding results are achieved with the devices known from the prior art, they are—like virtually all agitating ball mills—subject to the disadvantage that the point where the shaft penetrates the grinding basket is provided with a dynamic friction gap or other similar means, through which the grinding balls can escape from the housing or the grinding basket into the container. Furthermore, dynamic friction gaps require relatively narrow tolerances in order to function properly, meaning that their manufacture is complex and expensive. However, even with the highest precision manufacturing and faultless operation, the problem still occurs that the grinding balls are unintentionally crushed in the friction gap, thereby destroying the friction gap and contaminating the product to be dispersed.

Another problem occurs at the annular through-opening between the shaft and the housing. During operation, these components move relative to one another. The product to be dispersed flows through this annular gap into the housing, as is required for the grinding process.

On the other hand, this through-opening is associated with the considerable disadvantage that grinding balls uncontrollably and unintentionally escape from the housing during the grinding process. This is disadvantageous in two respects. On the one hand, the product to be dispersed must be filtered again after the grinding process and prior to further processing in order to filter out the beads, thus necessitating an additional, time-consuming processing step. On the other hand, the loss of beads must be compensated for at regular intervals, as the grinding performance would otherwise decline.

A basket mill is known from EP 0 546 715, whose upper housing cover has a cylindrical collar on top, in which an impeller provided on the shaft runs. This device also does not prevent the grinding media from unintentionally leaving the housing.

BRIEF SUMMARY OF THE INVENTION

Consequently, the technical object of the invention is to further develop a dispersing device of the kind specified at the outset, such that the grinding balls are reliably prevented from escaping from the housing or the grinding basket.

According to the invention, the object is solved in that a second flow-producing device, designed as an impeller, is provided in the region of the through-opening between the shaft and the housing, and in that the housing in the region of the through-opening is designed as a pump housing in the shape of a half-shell to accommodate the impeller, in order to prevent the escape of the grinding balls.

As a result of the design according to the invention, the relative movement generates a flow into the inside of the housing of the grinding device. This flow is so strong that it reliably prevents the grinding balls from escaping through the through-opening and into the product to be dispersed inside the container. In addition, the second flow-producing device results in more thorough mixing and draws the product to be dispersed into the housing of the grinding device more rapidly, thus increasing the throughput.

Finally, the flow-producing device deflects the grinding balls that escape from the grinding basket through the through-opening. Should this deflection be inadequate for preventing the grinding balls from getting into the through-opening in any manner whatsoever, the flow generated by the flow-producing device is sufficient to suck any balls that still escape back into the grinding basket or grinding device. Moreover, the design of the grinding device according to the invention is associated with the special advantage that the flow generated by the flow-producing device holds even considerably lighter and cheaper grinding balls (e.g. designed as glass beads) inside the grinding device, so that heavier and more expensive grinding balls, such as those made of zirconium oxide, which are usually required for numerous grinding processes due to their greater density and resultant weight, can be dispensed with. The use of cheaper grinding balls made of glass substantially reduces grinding costs.

The flow-producing device is preferably designed as an impeller and the housing of the grinding device has a pump housing in the region of the through-opening in order to accommodate the impeller. Thus, the impeller runs in an area of the housing of the grinding device specifically designed for its accommodation. The impeller and the housing thus form a pump for drawing liquid into the inside of the housing.

It is particularly advantageous if the pump housing is essentially in the shape of a half-shell, into which the impeller can be inserted such that its blades or webs face the housing wall.

In a particularly advantageous configuration, the upper region of the housing is of funnel-shaped design and provided on the side of its base facing away from the funnel with the pump housing for the impeller. In this context, the through-opening can be located at the base of the funnel, so that the product to be dispersed, which is drawn into the inside of the container by the impeller, flows down, or is drawn down the funnel walls.

The impeller can achieve greater pumping power if the pump housing has inclined walls that are adapted to the incline of the blades on the impeller.

The gap between the impeller and the housing is preferably designed such that it is larger than the diameter of the grinding balls, so that it is impossible for the grinding balls to get caught between the impeller and the pump housing.

In an advantageous configuration, the outer circumferential edge of the opening of the pump housing facing the inside of the housing is provided with a circumferential lip. This lip prevents the grinding balls from directly entering the region between the impeller and the pump housing. If the lip is of suitable design, the grinding balls are deflected back into the inside of the grinding device.

It has proven to be particularly advantageous for the impeller to be provided with a disk-shaped plate, on which at least one blade-like web is arranged, which extends essentially at an angle to the plane of the plate in the direction of the rotational axis of the plate and, in the radial direction on the plate, runs essentially at an angle to a tangent to the outer circumferential edge of the plate. In this context, it is possible to provide only one blade-like web on the plate, which extends in helical fashion from the central rotational axis of the plate on the outer circumferential edge, or also several wings. The second configuration has proven to be particularly effective in practice. In a simplified configuration, the webs are only arranged radially on the plate (without curvature and not offset at an angle).

In another configuration, the longitudinal extension of the webs is of sickle-shaped design, due to the fact that this design ensures better deflection of the beads and greater pumping power.

It is generally conceivable to have various web forms for the impeller, which can be exchanged depending on the viscosity of the medium to be ground. To this end, it is particularly advantageous when the impeller is mounted in the grinding device in detachable fashion, in order to ensure easy exchange. In this context, the impeller can be driven by the shaft that drives the flow-producing device, or also by another, hollow shaft that is concentric to the first shaft and surrounds it.

It has proven to be particularly advantageous for the agitating tool to have an annular disk that is provided with a circumferential, step-like shoulder, on which the plate of the impeller can be mounted. The impellers can then be easily exchanged, depending on the type of application. Alternatively, however, the impeller and the annular disk can also be designed as a single part.

As mentioned, the grinding device and the flow-producing device need not be driven by the same shaft. Rather, a second shaft can be provided which makes it possible to drive the agitating tool and the impeller connected to it separately from the first shaft.

It has proven to be particularly advantageous in practice for the second shaft to be a hollow shaft that is concentric to the first shaft and encloses it. In this configuration, the two shafts can be operated separately, so that pre-dispersion is performed by the flow-producing device. For fine dispersion, the outer hollow shaft engages the first shaft by way of a coupling and rotates at the same speed. Alternatively, it is also possible to drive the two shafts independently of one another and have them rotate at different speeds.

In a particularly advantageous configuration of the grinding device, the flow-producing device has means for dispersion. In addition, the grinding device is of adjustable height, where the grinding device can be submerged into the product to be dispersed and fully withdrawn again using the height adjustment feature, while the flow-producing device remains in the product to be dispersed. This design enables particularly simple and economical separation of pre-dispersion, which is performed by the flow-producing device preferably designed as a dissolver, and fine dispersion, which is performed by the grinding device.

Particularly good dispersion results are obtained, and the grinding device is especially easy to clean, if it is designed such that its housing has an open profile, the agitating tool is driven by a second shaft and connected to the second shaft by at least one connector running through the open profile, and the second shaft is a hollow shaft that encloses the first shaft.

The invention also applies to agitating ball mills in which the shaft is fixed and bears the agitating tool, and where the housing rotates relative to the agitator. In this case, an agitating ball mill of this kind is designed such that the second flow-producing device has a blade-like web, which is provided on the housing and generates a flow through the through-opening into the inside of the housing.

The flow-producing device is advantageously provided with one or more webs located on the housing in the region of the through-opening.

BRIEF DESCRIPTION OF THE SEVERAL VIEWS OF THE DRAWING

The foregoing summary, as well as the following detailed description of the invention, will be better understood when read in conjunction with the appended drawings. For the purpose of illustrating the invention, there are shown in the drawings embodiments which are presently preferred. It should be understood, however, that the invention is not limited to the precise arrangements and instrumentalities shown. In the drawings.

DETAILED DESCRIPTION OF THE INVENTION

Figure 1:
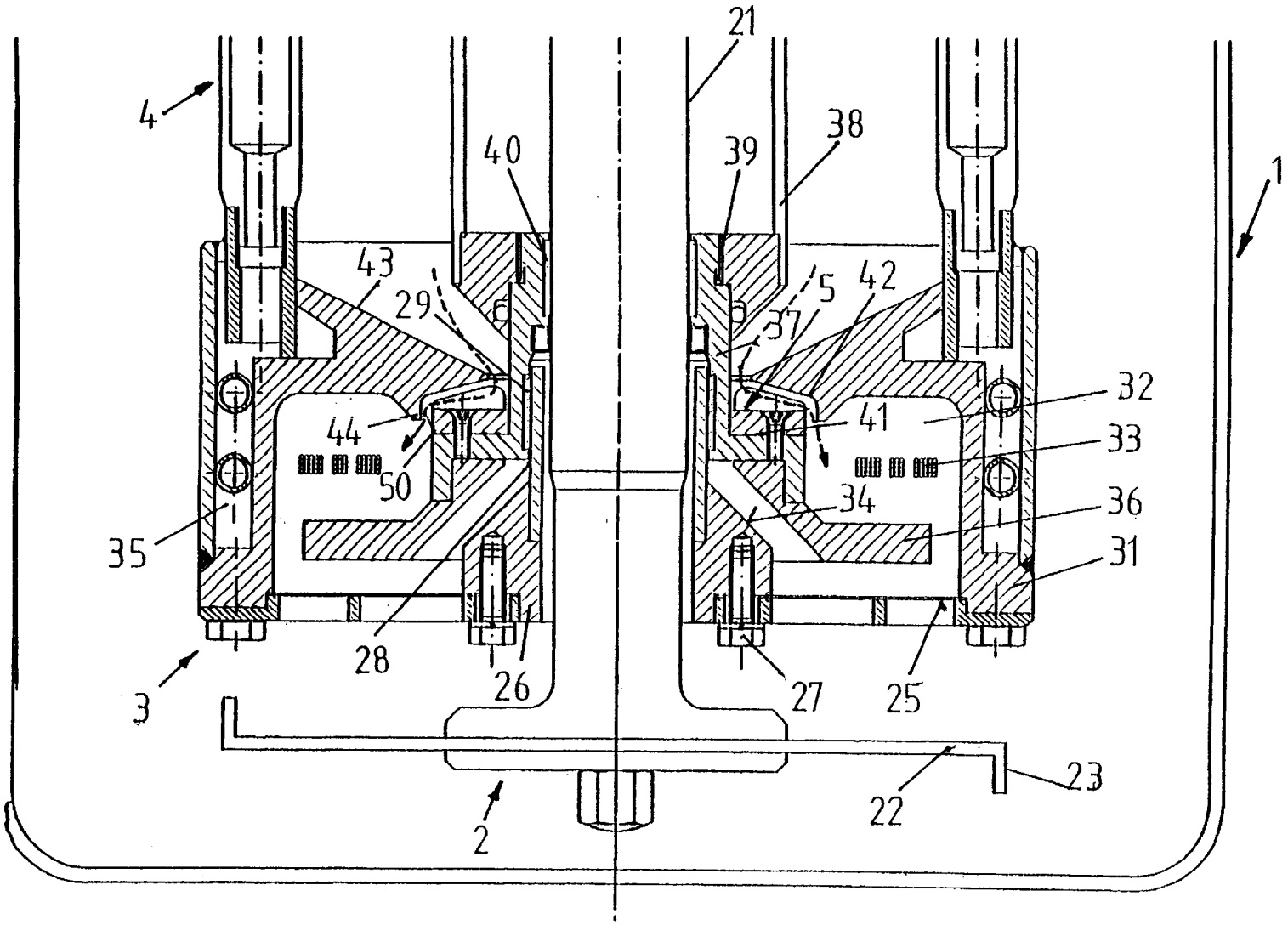
FIG. 1 is cross-sectional front view of the dispersing device according to the invention.

As shown in FIG. 1, the dispersing device according to the invention essentially consists of a cylindrical container 1, a dissolver 2 and an agitating ball mill 3. FIG. 1 shows only the bottom section of container 1.

The dissolver consists of a cylindrical shaft 21 that has a dissolver disk 22 on its lower end. The dissolver disk is equipped with several teeth 23 around its perimeter which are alternately bent up and down on the circular disk.

The agitating ball mill preferably consists of a toroidal housing 31, in which an annular channel 32 is formed. Grinding balls 33 are contained in annular channel 32. Grinding balls 33 are shown only roughly in the figure as examples. Annular channel 32 is usually filled with grinding balls 33. Housing 31 has a circumferential opening 34 on the side facing shaft 21. In the example shown, housing 31 is of double-walled design, where a temperature-regulating medium can be fed in as desired via bars 4, which are designed to lower housing 31, between the walls and into flushing space 35 formed between the walls, which is also of annular design. For this purpose, bars 4 are of hollow design and contain a feed channel and a drain channel for the temperature-regulating medium.

The bottom end of the housing shown in FIG. 1 is sealed with a sieve-like perforated disk 25, which is screwed to housing 31. The product to be dispersed flows through perforated disk 25 and thus through housing 31. At the same time, perforated disk 25 prevents grinding balls 33 from falling out of annular channel 32. The product to be dispersed enters housing 31 through the through-opening between housing 31 and the shaft. The flow of the product to be dispersed is indicated in this region by the dashed arrow.

A central bush 26 is mounted with screws 27 on perforated disk 25. Bush 26 accommodates a cylindrical sleeve 28. A round sliding bearing 29 is located between the outside of sleeve 28 and the inside of connector sleeve 37. Sliding bearing 29 prevents grinding balls 33 from being able to unintentionally get into the gap between connector sleeve 37 and cylindrical sleeve 28. At the same time, sliding bearing 29 enables the two components to move relative to one another.

An annular disk 36 is located inside annular channel 32, which runs coaxially to the ring and is linked via connector sleeve 37 to a hollow shaft 38 that encloses shaft 21. Shaft 21 and hollow shaft 38 are driven by a motor that is not described in any further detail here.

Shaft 21 is mounted in connector sleeve 37 such that it can rotate relative to it. In the present case, the mount is established by another sliding bearing 40 located between the inside of connector sleeve 37 and the outside of shaft 21. This simultaneously permits the simple axial shifting of housing 31 and hollow shaft 38 relative to shaft 21 of dissolver 2.

Connector sleeve 37 has a circumferential, step-like shoulder 41, on which impeller 5 is mounted. Alternatively, impeller 5 can also be designed as part of connector sleeve 37 or annular disk 36.

Impeller 5 consists of an annular and disk-shaped plate 50, on which several blade-like webs are arranged, which extend essentially at an angle to the plane of the plate in the direction of the rotational axis of plate 50 and, in the radial direction from the rotational axis, run essentially at an angle to a tangent to the outer circumferential edge of plate 50. During the rotation of impeller 5 with connector sleeve 37, the impeller generates a flow through the central hole of housing 31 into annular channel 32 of housing 31.

In order to enhance the flow effect, a pump housing 42 is provided on housing 31 in the region of the through-opening in order to accommodate impeller 5 in housing 31. The housing 31 additionally has a funnel-shaped inlet 43, which is provided on the side of its base facing away from the funnel with pump housing 42 for impeller 5.

Pump housing 42 has an inclined wall that is adapted to the inclination of the webs of the impeller. This design provides for greater pumping power, as pump housing 42 is closer to the webs of the impeller at every point. The gap between the upper edge of the webs and the wall of the pump housing is dimensioned such that a grinding ball 33 cannot get caught between them.

In order to reliably prevent grinding balls 33 from entering during the grinding process, the outer circumferential edge of the opening of pump housing 42 facing the inside of the housing is provided with a circumferential lip 44. In this case, lip 44 is designed as part of housing 31 and reliably prevents grinding balls 33 from entering pump housing 42 from the side.

Figure 2:
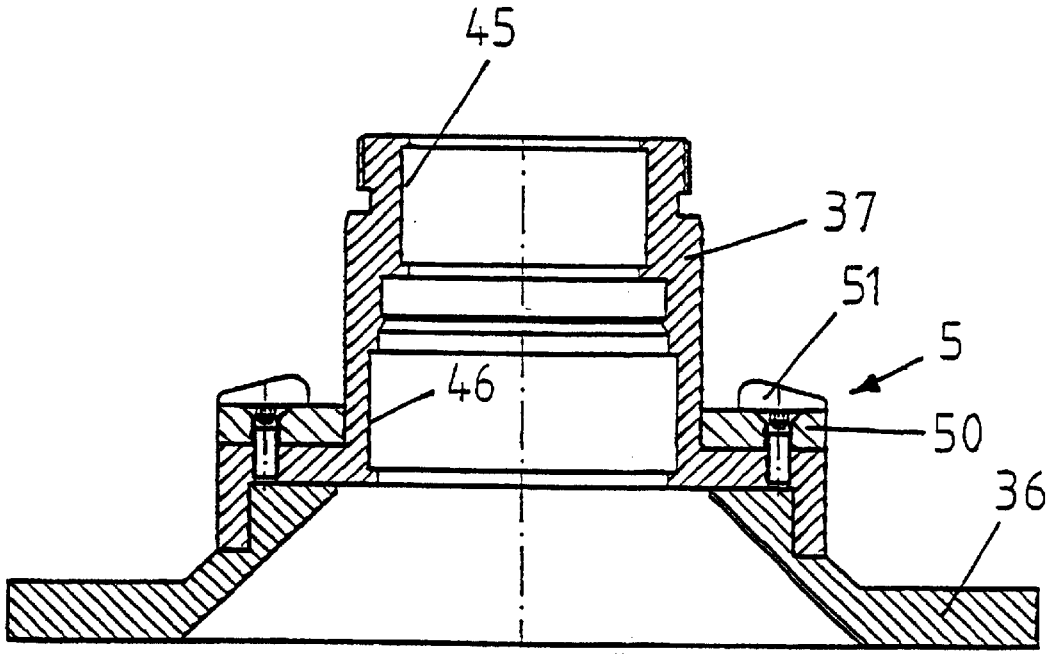
FIG. 2 is a cross-sectional side view of the agitator disk with the impeller mounted on top.

FIG. 2 shows connector sleeve 37 with annular disk 36 mounted on it and without the other components. Clearly visible on the inside of connector sleeve 37 are recesses 45 and 46, in which sliding bearings 29 and 40 can be inserted in order to prevent the axial shifting of sliding bearings 29 and 40. Alternatively, connector sleeve 37 and annular disk 36 can be designed as a single part.

Impeller 5, with plate 50 and webs 51 arranged on it, is clearly discernible. Webs 51 are designed such that they do not extend to the inside edge of plate 50. As a result of this design, the product to be dispersed can flow better through the through-opening into annular channel 32 of housing 31. This flow is indicated by arrows in FIG. 1.

The compact arrangement of annular disk 36, sliding bearings 29 and 40, and impeller 5 enables the particularly efficient exchange of the wear-sensitive parts.

Figure 3:
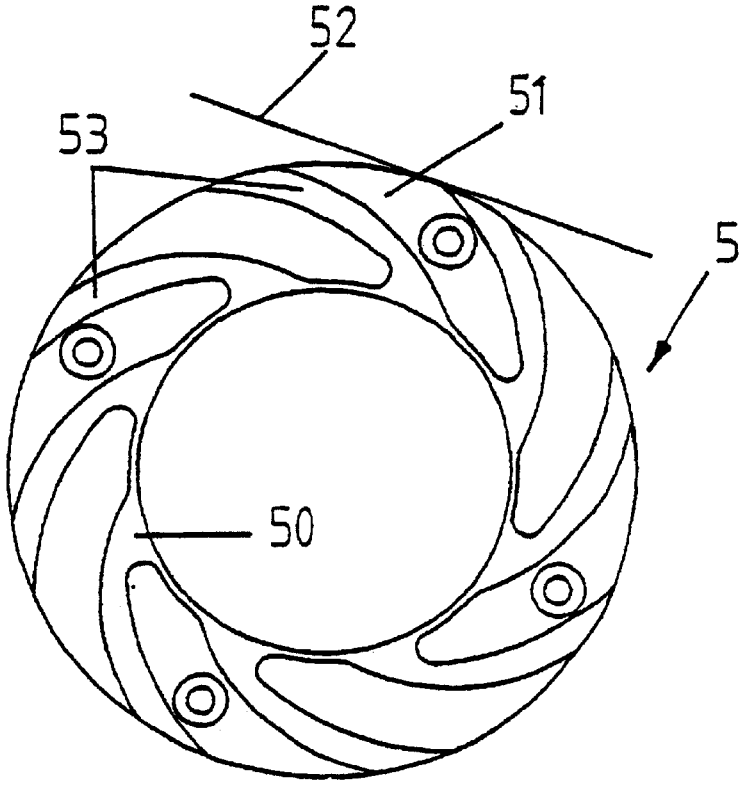
FIGS. 3–8 are top views of various configurations of the impeller according to the invention.

FIG. 3 shows a top view of impeller 5. Annular plate 50 is clearly visible, from which the blade-like webs 51 rise up towards the observer. Webs 51 extend essentially at an angle to a tangent 52 to the outer circumferential edge of plate 50 and are of essentially sickle-shaped design. This designs makes it possible to achieve particularly great pumping power and simultaneously provides for the continuous deflection of grinding balls 33 that flow from the outside towards impeller 5. During operation, the product to be dispersed inside the dispersing device flows in the direction of view into the inner through-opening and is transported by the rotation through channels 53 formed between webs 51 and towards the outer circumferential edge of impeller 5. The sickle-shaped design of webs 51 further accelerates the product to be dispersed.

Figure 4:
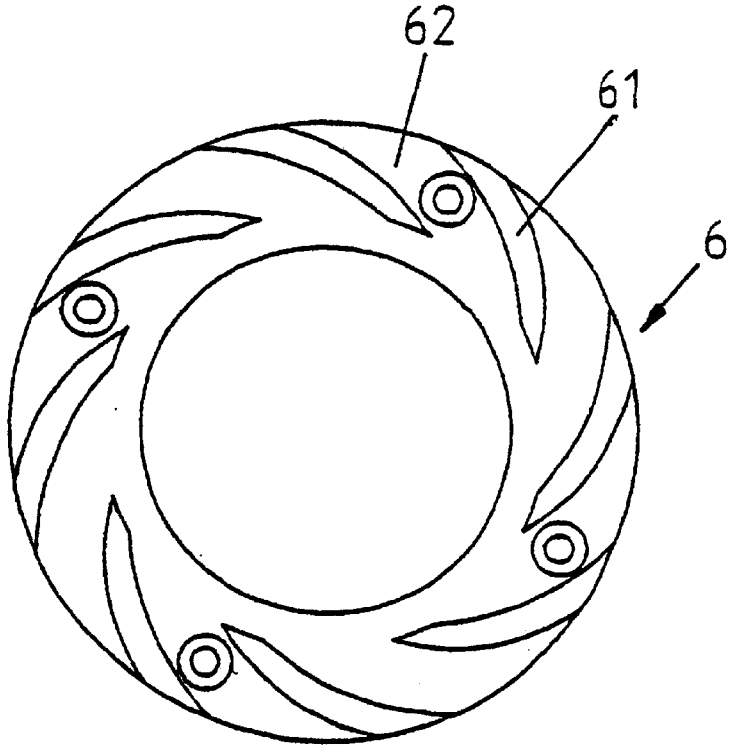
Figure 5:
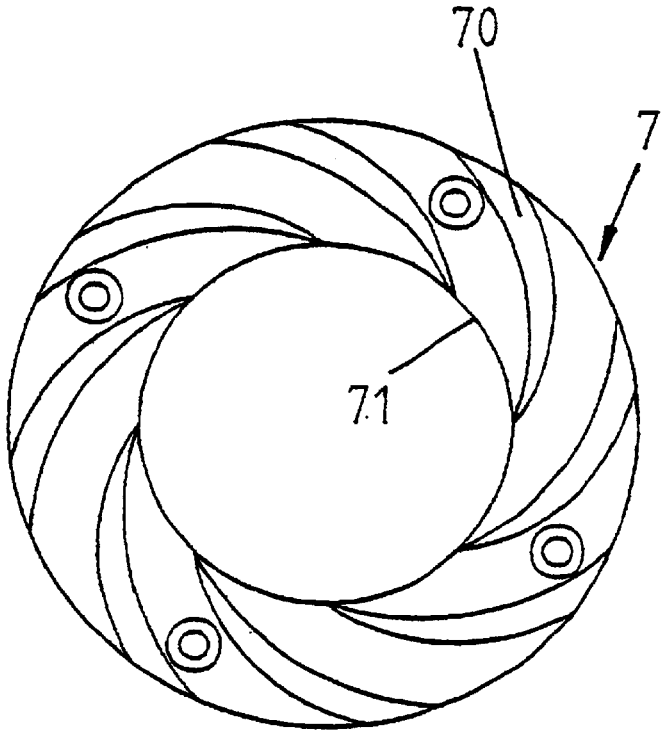

FIG. 4 also shows a top view of an alternative configuration of an impeller 6. In this design, webs 61 are of narrower design than those of the impeller according to FIG. 3, so that channels 62 between the webs are wider. An impeller 6 of this kind can be used, for example, for relatively high-viscosity products to be dispersed.

Figure 6:
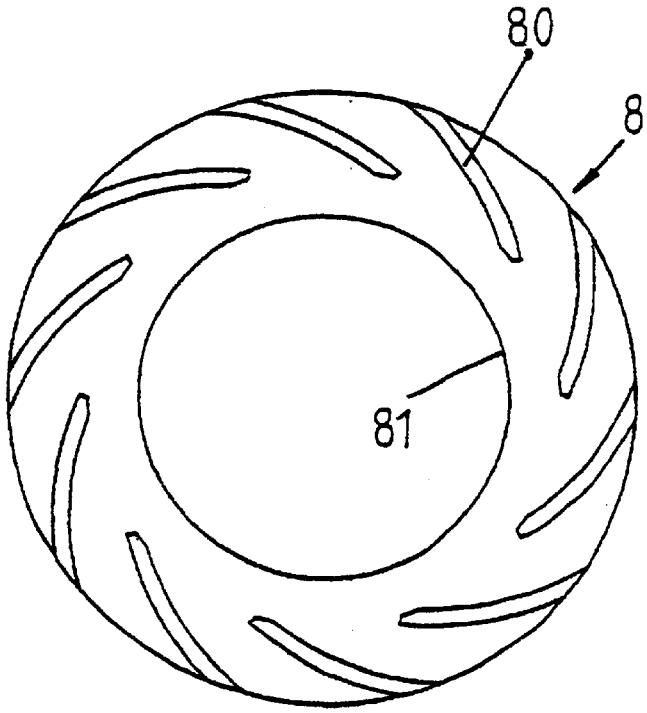

In contrast, FIG. 6, which also shows a top view of an alternative configuration of an impeller 8, has an impeller 8 with very narrow webs 80 that do not extend to the inside edge 81 of impeller 8.

Figure 7:
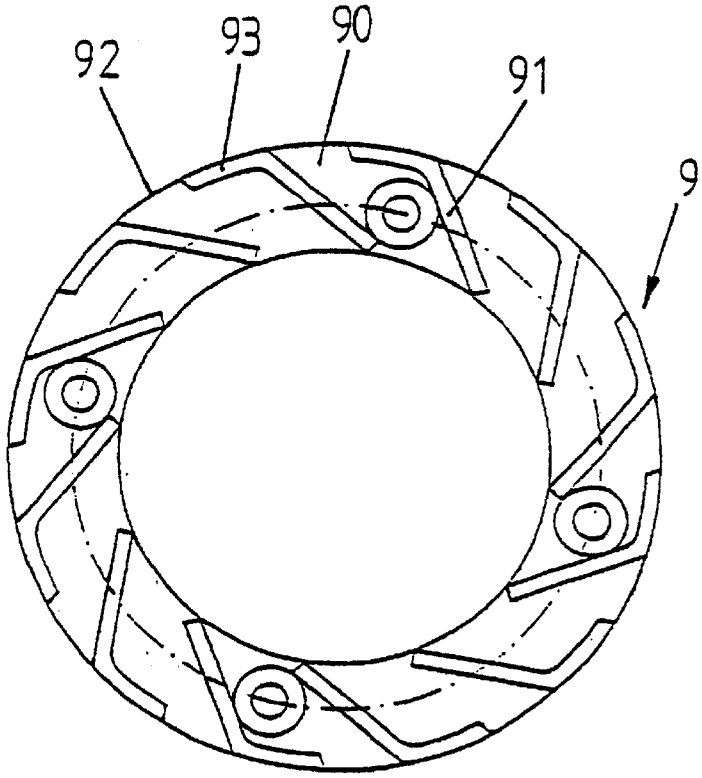

FIG. 7 shows a top view of another configuration of the impeller according to the invention. Annular plate 9 of impeller 9 is provided with webs 91, which are essentially designed in accordance with the webs of the other impellers 5 to 7 described above. In contrast to these, webs 91 are also provided on outer circumferential edge 92 with extensions 93 that run along this circumferential edge. In this top view, webs 91 look like hockey sticks. Extensions 93 of the webs deflect the product to be dispersed once more and cause increased turbulence and improved mixing of the product to be dispersed. In addition, the outer extensions also provide for the particularly reliably deflection of any grinding balls 33 that may enter pump housing 42.

Figure 8:
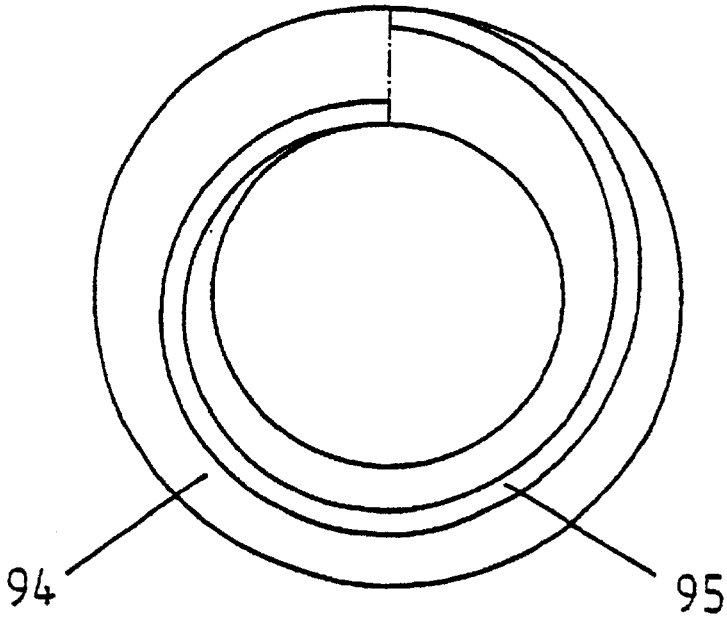

Finally, FIG. 8 shows an alternative configuration of the impeller according to the invention, where a single web 95 running helically from the inside edge to the outside circumferential edge is provided on plate 94.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

We claim:

1. A dispersing device comprising a container that receives and processes a product to be dispersed; a grinding device with a housing that contains grinding bodies, wherein said housing has openings enabling the product to be dispersed to pass through; an agitating tool arranged in the housing and a first flow-producing device, wherein the housing and the agitating tool can move relative to one another; and at least one shaft protrudes into the housing via a through-opening that allows the product to be dispersed to enter the housing, further comprising a second flow-producing device, designed as an impeller (5, 6, 7, 8), provided in the housing in the region of the through-opening between the at least one shaft (21) and the housing (31), wherein the housing (31) in the region of the through-opening is designed as a pump housing in the shape of a half-shell to accommodate the impeller (5, 6, 7, 8), in order to prevent the escape of the grinding balls.

2. The grinding device as per claim 1, wherein the housing (31) has a funnel-shaped inlet (43), which is provided on a side of its base facing away from the inlet (43) with the pump housing (42).

3. The grinding device as per claim 1, wherein an outer circumferential edge of the opening of the pump housing (42) facing an inside of the housing is provided with a circumferential lip (44).

4. The grinding device as per claim 1, wherein the impeller (5, 6, 7, 8) is provided with a disk-shaped plate (50, 90), on which at least one blade-like web (51, 61, 70, 80, 91) is arranged, which extends essentially at an angle to the plane of the plate in a direction of the rotational axis of the plate (50, 90) and, in a radial direction on the plate (50, 90), runs essentially at an angle to a tangent to an outer circumferential edge of the plate (50, 90).

5. The grinding device as per claim 4, wherein the impeller (5, 6, 7, 8) has several webs (51, 61, 70, 80, 91).

6. The grinding device as per claim 4, wherein a longitudinal extension of the web (51, 61, 70, 80, 91) is of sickle-shaped design.

7. The grinding device as per claim 4, wherein the agitating tool has an annular disk (36), which is provided with a circumferential, step-shaped shoulder (41), on which the plate (50, 90) of the impeller (5, 6, 7, 8) is located.

8. The grinding device as per one claim 1, wherein the agitating tool is driven by another shaft.

9. The grinding device as per claim 1, wherein the first flow-producing device has a disperser, the grinding device is of adjustable height, and the grinding device is submersible into the product to be dispersed and fully withdrawn again using a height adjustment feature, while the flow-producing device remains in the product to be dispersed.

10. The grinding device as per claim 1, wherein the shaft is fixed and bears the agitating tool, wherein the housing rotates relative to the agitating tool, and wherein the second flow-producing device has a blade-like web, which is provided on the housing (31) and generates a flow through the through-opening into the inside of the housing (31).

11. The grinding device as per claim 10, wherein the second flow-producing device is provided with several webs designed as an integral part of the housing in a region of through-opening.

12. The dispersing device as per claim 1, wherein the dispersing device is a ball or bead mill for use as a submersible mill.

* * * * *